United States Patent [19]

Hoch et al.

[11] 4,412,519

[45] Nov. 1, 1983

[54] DIESEL FUEL DISTRIBUTOR TYPE INJECTION PUMP

[75] Inventors: Martin M. Hoch, Rochester; Donald Stoltman, Henrietta, both of N.Y.

[73] Assignee: General Motors Corporation, Detroit, Mich.

[21] Appl. No.: 417,385

[22] Filed: Sep. 13, 1982

[51] Int. Cl.[3] ..... F02M 41/00

[52] U.S. Cl. ..... 123/449; 123/500; 123/458; 123/459; 417/500

[58] Field of Search ..... 123/449, 501, 500, 495, 123/458, 459, 446; 417/500, 492, 485

[56] References Cited

U.S. PATENT DOCUMENTS

| | | | |
|---|---|---|---|
| 1,664,608 | 4/1928 | French | 123/458 |
| 2,147,390 | 2/1939 | Vaudet | 123/501 |
| 2,535,535 | 12/1950 | Fleck | 123/501 |
| 4,197,058 | 4/1980 | Simko | 123/449 |
| 4,241,714 | 12/1980 | Knape et al. | 123/500 |

FOREIGN PATENT DOCUMENTS

| | | | |
|---|---|---|---|
| 392359 | 11/1908 | France | 417/500 |
| 565829 | 2/1924 | France | 417/500 |
| 55-112883 | 9/1980 | Japan | 417/500 |
| 953348 | 3/1964 | United Kingdom | 123/449 |

*Primary Examiner*—Ira S. Lazarus
*Assistant Examiner*—Magdalen Moy
*Attorney, Agent, or Firm*—Arthur N. Krein

[57] ABSTRACT

The reciprocating plunger reciprocable in the pump cylinder of a distributor type diesel fuel injection pump is helically splined to an index ratchet gear that is also operatively associated with a pawl detent whereby the index ratchet gear is rotatable in only one direction. The plunger has a discharge slot on its outer peripheral surface which registers with one of the plural discharge ports opening from the pump cylinder and the plunger controls the covering and uncovering of a fuel inlet port to the pump cylinder. Upon a pump stroke of the plunger, the index ratchet gear is rotated so that the next adjacent tooth is brought into alignment with the pawl detent to then prevent its rotation in the opposite direction during the suction stroke of the plunger.

With the index ratchet gear thus fixed, the plunger is thus rotated on the suction stroke so as to align the discharge slot with the next adjacent discharge port. A normally open solenoid valve controls spill flow from the pump cylinder during a pump stroke of the plunger so as to control the start and end of fuel injection.

4 Claims, 3 Drawing Figures

DIESEL FUEL DISTRIBUTOR TYPE INJECTION PUMP

This invention relates to a fuel injection pump and, in particular, to a distributor type, solenoid valve controlled, diesel fuel injection pump of the single plunger type which is adapted to deliver metered amounts of fuel sequentially to a plurality of fuel injection nozzles associated with the cylinders of an internal combustion engine.

DESCRIPTION OF THE PRIOR ART

Single plunger, distributor type fuel injection pumps of the type shown, for example, in U.S. Pat. No. 2,965,087 entitled Fuel Injection Pump, issued Dec. 20, 1960 to Bischoff et al., are well known and are used to sequentially supply fuel to a plurality of fuel injection nozzles for injection into the associate cylinders of a diesel engine.

In the known pumps of the above-identified type, a rotary shaft carrying a cam is used to effect reciprocation of the plunger and a gear train driven by the shaft is used to effect rotation of the plunger whereby the plunger operates both as a pump element to pressurize fuel and as a distributor element to sequentially distribute the charge of pressurized fuel to one of the fuel injection nozzles. Thus in such prior art pumps, a gear train means is normally used to effect continuous rotation of the plunger during pump operation.

It is also well known in the art that an electronic regulated fuel pump permits for a more accurate control of fuel injection and that such an electronic regulated fuel pump is also normally less expensive to manufacture than a comparable mechanical or hydraulically regulated fuel pump.

SUMMARY OF THE INVENTION

The present invention relates to an engine driven distributor type, solenoid valve controlled, single plunger pump assembly that is operative to sequentially deliver pressurized fuel to a plurality of fuel injection nozzles for the respective cylinders of a diesel engine, the fuel delivery from the pump being controlled by a solenoid actuated valve that is electrically connectable so as to be energized by a suitable electronic control device as function of engine operating conditions.

It is therefore a primary object of the invention to provide an improved single plunger type fuel injection pump wherein the plunger is operatively associated with an index ratchet gear so that during reciprocation of the plunger, the plunger during a pump stroke thereof effects an indexed angular rotation of the index ratchet gear and the plunger on its return or suction stroke is caused to rotate accordingly by the previously rotated index ratchet gear whereby to then align a discharge slot on the plunger for discharge on the next pump stroke to the next fuel injection nozzle in the sequential alignment of the discharge ports to the nozzles.

Another object of the invention is to provide an improved distributor type, single plunger fuel injection pump for an internal combustion engine wherein a solenoid actuated valve is incorporated into the pump assembly so as to control the spill from the pump chamber during a pump stroke so as to control injection of fuel as a function of engine operation.

A further object of the invention is to provide an improved fuel injection pump wherein a single plunger that is both reciprocated and sequentially rotated is used to supply pressurized fuel sequentially to a plurality of fuel injection nozzles, the start and end of fuel injection, during a pump stroke of the plunger, being controlled by a solenoid actuated valve spill passage, the solenoid actuated valve being adapted to be electronically actuated as a function of engine operation.

Still another object of the present invention is to provide a single plunger, fuel injection pump of the above type which includes features of construction, operation and arrangement, rendering it easy and inexpensive to manufacture, and in other respects suitable for use on diesel engines.

For a better understanding of the invention, as well as other objects and further features thereof, reference is had to the following detailed description of the invention to be read in connection with the accompanying drawings.

DESCRIPTION OF A PREFERRED EMBODIMENT

Figure 1:
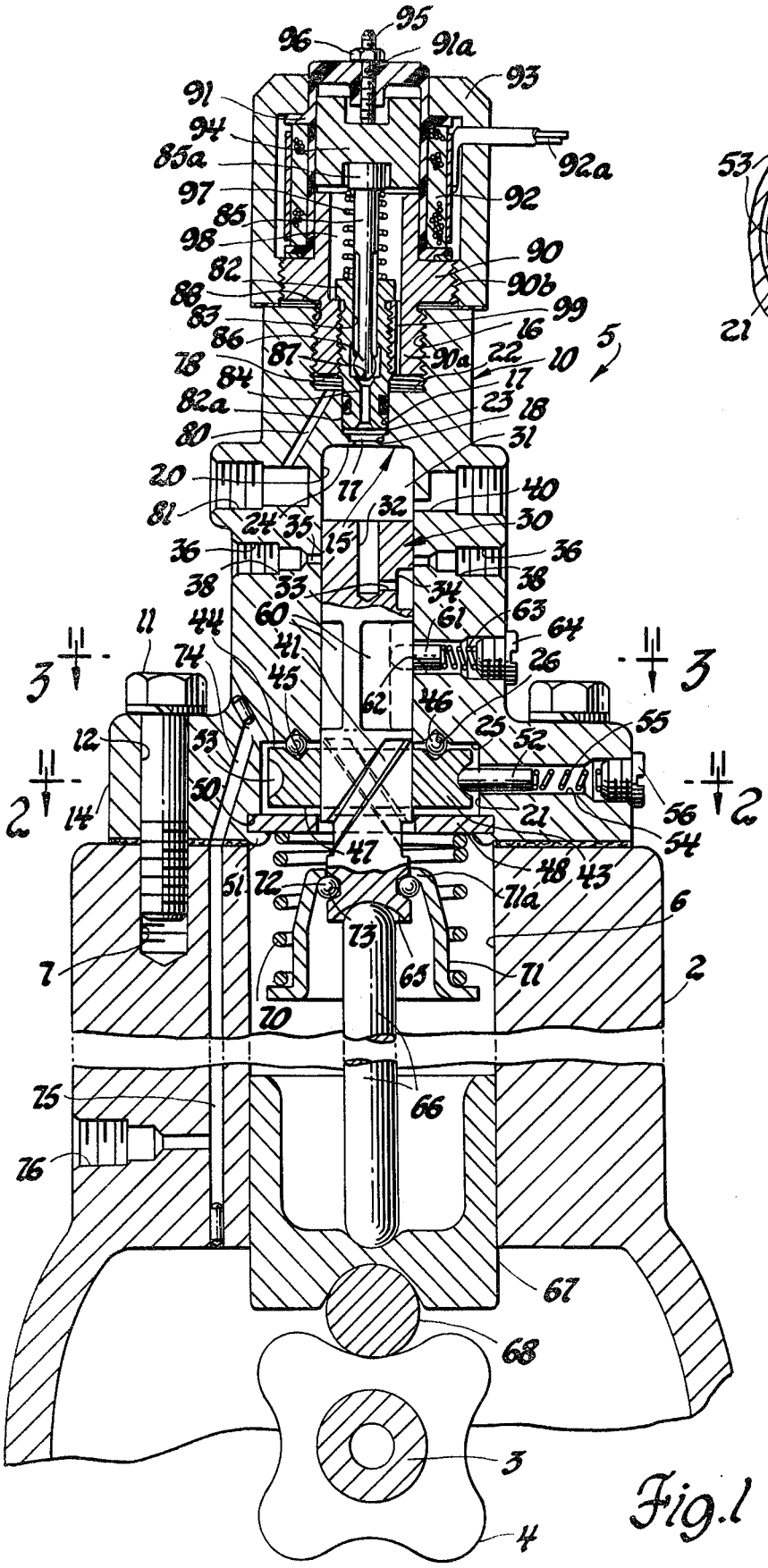
FIG. 1 is a cross-sectional view in elevation of a single plunger, distributor type, fuel injection pump in accordance with the invention, the plunger thereof being shown at the end of a suction stroke position.

Referring now to the drawings, the fuel injection pump of the invention, generally designated 5, is shown, by way of example, as being for a four-cylinder diesel engine.

In the construction shown, the pump 5 has a hydraulic head or pump body 10 which is preferably adapted, as shown, to be connected to the engine housing block 2 of an engine, the engine having the usual camshaft 3 journaled therein with a pump drive cam 4 thereon.

As shown in FIG. 1, the pump body 10 is positioned so as to overlie a lifter guide bore 6 in the engine block 2 and it is secured to the engine block as by bolts 11 which extends through apertures 12 provided in the flange 14 of the pump body, with these bolts being threaded into internally threaded apertures 7 provided for this purpose in the engine block 2.

Alternatively, in a manner well known in the pump art, the pump body 10 can be secured, if desired in a similar manner to conventional type pump casing having a drive shaft, carrying a cam, journaled therein, both not shown, the drive shaft then being adapted to be operatively connected to an engine whereby it is driven in time relationship thereto.

As is well known, the cam 4 would be provided with a plurality of lobes thereon depending on the number of cylinders in the associate engine with which the pump is to be used. Thus with reference to the embodiment shown and for use on a four-cylinder engine, the cam 4 would be provided with four cam lobes thereon if the associate camshaft 3 is driven at half-engine speed whereas, it would require only two such cam lobes thereon if the associate camshaft is driven at engine speed.

As best seen in FIG. 1, the pump body 10 is provided with a central axial stepped cylindrical through bore 15. Bore 15 defines, starting from the top with reference to FIG. 1, an internally threaded upper wall 16, an upper intermediate wall 17, a lower intermediate wall 18, a pump cylinder wall 20 and, a lower wall 21. The pump cylinder wall 20 is of a predetermined internal diameter so as to reciprocably receive a pump plunger 30. The lower wall 21, as shown in FIG. 1, is of substantially increased internal diameter relative to the internal diameter of the pump cylinder wall 20.

The walls 18, 17 and 16 are of progressively larger diameters, in the order named, relative to the pump cylinder wall 20. Walls 16 and 17 are interconnected by a flat shoulder 22. Walls 17 and 18 are interconnected by a flat shoulder 23. Walls 18 and 20 are interconnected by a flat shoulder 24. Walls 20 and 21 are interconnected by a flat bearing race shoulder 25 having an annular recessed ball race groove 26 therein.

The pump plunger 30 to be described in greater detail hereinafter, has the upper portion thereof reciprocably received by the pump cylinder wall 20 and is also rotatably guided by this pump cylinder wall. The plunger 30, which is adapted to be reciprocated through a predetermined axial extent and to also be sequentially rotated in a manner to be described in detail hereinafter, defines with the pump cylinder wall 20, a variable volume pump chamber 31.

To permit for the discharge of fuel from the pump chamber 31 in a sequential manner to the respective nozzles, not shown, for the engine cylinders, the plunger 30, in the embodiment shown, is provided with a discharge bore 32 which extends axially downward a predetermined distance from the upper end of the plunger so as to intersect a radially extending passage 33 which in turn at its other end opens into a discharge slot 34 provided on the outer peripheral surface of the plunger 30. The axial location of the discharge slot 34 relative to the top of the plunger 30 is preselected relatively the axial location of a plurality of discharge port passages 35 extending radially outward from the pump cylinder wall 20. As best seen in FIG. 1, the axial extent of the discharge slot 34 and the axial location of the inboard end of each of the discharge port passages 35 are both predetermined so that during the full stroke of the plunger 30, flow communication will exist between the discharge slot 34 and the then aligned associate one of said discharge port passages 35, the remaining discharge port passages 35, of course, then being covered by the outer peripheral surface of the plunger 30, thus preventing fluid flow thereto.

The number of said discharge port passages 35 will correspond to the number of cylinders of the engine with which the pump is to be associated and, these passages are thus circumferentially spaced apart around the pump cylinder wall 20 accordingly. For example, in the embodiment illustrated for a four-cylinder engine, four such discharge port passages 35 are provided, only two being seen in FIG. 1, and these passages are spaced 90° apart relative to each other.

In the construction shown in FIG. 1, each such discharge port passage 35 extends radially outward from the pump cylinder wall 20 so as to be in flow communication at its outboard end with the inner end of an associate radial extending stepped bore 36. Each bore 36 is preferably formed so as to define an enlarged diameter internally threaded outboard wall and an inboard internal wall of reduced diameter that defines a passage in flow communication with the outboard end of an associate discharge port passage 35, with these walls being interconnected by a flat shoulder 38.

The above-described preferred construction permits the threaded portion of the bore 36 to loosely receive a conventional retraction valve seat secured therein by means of a conventional retraction valve fitting, both not shown, the retraction valve fitting having one end thereof externally threaded for engagement with the internally threaded wall portion of this bore 36. The retraction valve seat is adapted to cooperate with a suitable retraction valve, not shown, in a conventional manner. The latter elements are not shown nor described in detail herein since such elements are well known in the pump art and since they form no part of the subject invention.

Fuel is supplied to the pump chamber 31 by means of a radial inlet passage 40 provided in the pump body 10. The outboard internally threaded end of the inlet passage is connectable, as by a fitting, not shown, to a source of fuel at a suitable supply pressure, not shown, while its inboard end opens through the pump cylinder wall 20 at a predetermined axial location therein. As is well known, the inlet passage 40 is located so that during a suction stroke of the plunger 30, this inlet passage 40 will be uncovered by the plunger 30 to permit the ingress of fuel into the pump chamber 31. During the pump stroke of the plunger 30, this inlet passage 40 will then be closed by the outer peripheral surface of the plunger after a predetermined upward travel of the plunger from the position shown in FIG. 1.

Figure 2:
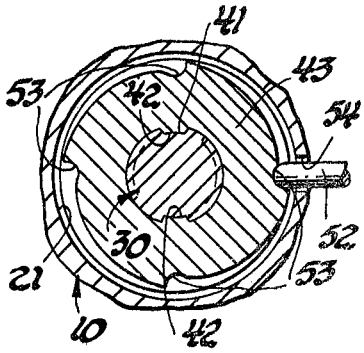
FIG. 2 is a cross-sectional view taken along lines 2—2 of FIG. 1 to show the plunger, index ratchet gear, and associate ratchet pawl detent arrangement therefore; and, FIG. 3 is a cross-sectional view taken along lines 3—3 of FIG. 1 to show details of a portion of the pump plunger and its associate ratchet and pawl detent arrangement.

Referring again to the plunger 30, this plunger, as best seen in FIGS. 1 and 2, is provided intermediate its ends with suitable slotted or grooved gear teeth 41 of a suitable spiral or helix profile for engagement with the corresponding splines or gear teeth 42 provided on the internal peripheral surface of the tubular index ratchet gear 43 of a pawl and ratchet mechanism to be described. As shown, the index ratchet gear 43 operatively encircles the plunger 30 and is loosely received in the cavity defined by the bore wall 21 of the pump body 10. As will become apparent, these gear teeth 41 and 42 may be spiraled either right hand or left hand as required to impart rotation of the plunger 30 relative to the index ratchet gear 43 in a predetermined direction, as desired.

In the construction illustrated, the index ratchet gear 43 is suitably rotatably supported in the pump body 10 as by having the flat upper surface 44 thereof provided with an annular recessed ball race groove 45 that is aligned with the corresponding ball race groove 26 in the pump body 10 whereby these grooves can rotatably receive a plurality of bearing balls 46 therebetween.

At its lower end, the index ratchet gear 43 is provided with a flat bearing surface 47 which is adapted to abut against the upper surface of a thrust washer 48 that loosely encircles the plunger 30. In the embodiment shown, this thrust washer 48 is fixed axially as by being sandwiched between a shoulder 50 in pump body 10 and a spun over radial flange portion 51 of this pump body so that the upper surface of the thrust washer 48 is positioned closely adjacent to the bearing surface 47 of the index ratchet gear 43 by a predetermined distance, as desired, to thus limit downward movement of the index ratchet gear.

As best seen in FIG. 2, the index ratchet gear 43 forms with a movable pawl or detent 52, a pawl and ratchet mechanism for a purpose to be described in detail hereinafter. Accordingly, the outer peripheral surface of the index ratchet gear 43 is provided with a plurality of circumferentially spaced apart ratchet teeth 53, the number of such teeth corresponding in number to the number of cylinders in the associate engine. Thus in the embodiment illustrated, four such ratchet teeth 53 are provided and these are configured whereby, in co-operation with the detent 42, this index ratchet gear 43 can only rotate in one direction, a clockwise direction with reference to FIG. 2.

The detent 52, as best seen in FIG. 1, is slidably positioned in a radially extending, detent guide bore 54 provided in the pump body 10 in a location so that the inboard end of this guide bore 54 opens through the bore wall 21 in radial alignment with the row of ratchet teeth 53 on the index ratchet gear 43. A spring 55, loosely positioned in the detent guide bore 54, abuts at one end against the outboard end of the detent 52 and at its other end against a spring abutment screw 56 threaded into the internally threaded, enlarged, outboard end of the guide bore 54, whereby the detent 52 is normally biased in a radial direction for engagement with the ratchet teeth 53 of the index ratchet gear.

In order to only permit rotation of the plunger 30 in the same direction as that of the index ratchet gear 43, a clockwise direction as viewed from the drive end thereof in the embodiment shown, a second pawl and ratchet means is operatively associated with the plunger 30.

For this purpose, the plunger 30, in the construction illustrated, is also provided with a plurality of circumferentially spaced apart ratchet teeth 60, located next adjacent to and above the gear teeth 41. As will now be apparent, the number of ratchet teeth 60 will also correspond to the number of cylinders of an associate engine as thus also to the number of ratchet teeth 53 on the index ratchet gear 43. As shown, the ratchet teeth 60 on the plunger 30 are of suitable configuration so as to be engaged by the ball like end of a detent 61 and are suitably axially elongated so as to permit them to be sequentially operatively associated with the detent 61 during the predetermined maximum reciprocating movement of the plunger 30.

As best seen in FIG. 1, the detent 61 is slidably positioned in a radial extending detent guide bore 62 formed in the pump body 10 whereby its inboard end opens through the pump cylinder wall 20 at a predetermined axial distance below the discharge port passages 35. A spring 63, loosely received in the detent guide bore 62, is positioned between the outboard end of the detent 61 and the inboard end of a spring abutment screw 64 threaded in the internally threaded outboard end of bore 62, is used to normally bias the detent 61 into operative engagement with the ratchet teeth 60 on plunger 30.

In the embodiment illustrated, the lower end of the plunger 30, with reference to FIG. 1, is provided with a semi-spherical socket 65 adapted to be engaged by one end of a push rod 66. The opposite end of the push rod 66 abuts against a tappet 67 reciprocably guided in the lifter guide bore 6 in the engine housing block 2. A roller follower 68 is operatively associated with the tappet 67 for rolling engagement with the cam 4 whereby to effect a pump stroke of the plunger 30.

The return stroke of the plunger 30 is affected by means of a coiled plunger return spring 70. In the construction shown, this spring 70 is positioned to loosely encircle the lower end of the plunger 30 with one end thereof positioned to abut against the lower surface of thrust washer 48 and its other end to abut against the radial flange of an inverted cup-shaped spring retainer 71 that is suitably fixed to the plunger 30.

To permit rotation of the plunger 30, the upper base end 71*a* of the retainer is turned in and centrally apertured so as to loosely encircle the plunger 30 and to serve as the outer race for a plurality of bearing balls 72 rotatably engaged in an annular ball race groove 73 formed in the plunger 30 next adjacent to its lower end. With this arrangement, the plunger 30 is thus free to rotate relative to the spring 70 and spring retainer 71.

In order to insure the adequate lubrication of the bearing balls associated with the index ratchet gear 43 and spring retainer 71, there is provided, in the embodiment shown, an inclined lubricating passage 74 in the pump body 10 which at one end opens through shoulder 25 and wall 21 for the discharge of oil onto the index ratchet gear 43. At its other end, this passage 74 is in flow communication with a vertical passage 75 provided in the engine block 2 so as to intersect a supply passage 76 that is adapted to be connected by a suitable fitting, not shown, to a source of pressurized lubrication oil, for example, the lubricating oil pump, not shown, of the associate engine.

Referring now to another feature of the invention, means are provided to effect the controlled spill of fuel from the pump chamber 31 via a spill port passage means during a pump stroke of the plunger 30 whereby to control the start and end of injection and to thereby control the quantity of fuel supplied by this pump to the fuel injection nozzles, not shown, for the cylinders of the associate engine.

For this purpose, flow through a spill port passage 77 defined by the walls 17 and 18 in the pump body 10, which is in flow communication at one end with the pump chamber, to a low pressure fuel drain passage means is controlled by a normally open, solenoid actuated valve. The upper portion of this fuel drain passage means includes a chamber 78 defined by part of the upper wall 16 and shoulder 22 in the pump body 10.

As shown in FIG. 1, this chamber 78 is in flow communication via an inclined passage 80 to a radial, internally threaded drain port 81 which is adapted to be connected by a suitable fuel drain conduit, not shown, to the engine fuel tank, not shown, containing fuel at a pressure corresponding substantially to atmospheric pressure.

In the construction illustrated, a valve cage 82, secured in a manner to be described, is provided with a stepped bore passage 83 therethrough providing an orifice passage 84 of predetermined flow area at its lower end opening into the spill port passage 77. The upper enlarged diameter portion of the passage 83 is adapted to slidably receive the fluted stem of a solenoid actuated valve 85 having its valve tip 86 positioned for engagement with a valve seat 87 encircling the upper end of the orifice passage 84.

As shown, valve cage 82 is threadingly engaged in the lower, internally threaded portion of a stepped bore 88 in a tubular solenoid pole piece 90 that has its externally threaded lower reduced diameter end 90*a* threadingly engaged in the internally threaded portion of the upper wall 16 of the pump body 10. With this arrangement the reduced diameter lower end 82*a* of the valve cage 82 is located so as to extend into suitable sealed engagement with the internal upper intermediate wall 17 of the pump body 10.

This pole piece 90, at its upper end, is of reduced external diameter so as to extend into the open end of a cup-shaped bobbin 91 provided with a wound magnetic wire solenoid coil 92. The terminal electrical leads 92*a* of this solenoid coil being adapted to be connected to a suitable source of electrical power via a suitable conventional fuel injection electronic control circuit, not shown, whereby the solenoid coil can be energized as a function of the operating conditions of an associate engine in a manner well known in the art.

Bobbin 91, with its solenoid coil 92, is secured to the pole piece 90 by means of a cup-shaped retainer nut 93 threaded onto the external threads 90*b* of the pole piece 90.

A plunger-like armature 94 is slidably received in the bore of bobbin 91 between its upper closed end and the upper free end of the pole piece 90 for movement between this upper free end of the pole piece and a stop 95 adjustably threaded through a threaded aperture 91*a* in the upper end of the bobbin and which is adapted to be fixed by a nut 96.

A rate spring 97 is positiond to loosely encircle the stem of valve 85 with one end of this spring in abutment against the valve cage 82 and with its other end in abutment against the head 85*a* of the valve 85. Spring 97 thus normally biases the valve 85 to an open or unseated position relative to the valve seat 87, the position shown in FIG. 1, and thus is also operative to bias the armature 94 in a corresponding direction into abutment against the stop 95.

With this arrangement, when the solenoid coil 92 is energized, the armarture 94 is moved in the opposite direction, downward from the position shown in FIG. 1, toward the pole piece 90, whereby to effect movement of the valve 85 into seating engagement with the valve seat 87. As will be apparent the normal working air gap between the opposed working surfaces of the armature 94 and pole piece 90 is preselected so as to permit seating of the valve 85.

As seen in FIG. 1, the interior of the pole piece 90 above the valve cage 82 surrounding the valve 85 forms a fuel spill return chamber 98 that is in flow communication with the chamber 78 via one or more axial extending passages 99 provided for this purpose in the pole piece 90.

Functional Description

During engine operation, the push rod 66 is driven by the cam 4, via the lifter 67 and follower 68. The push rod 66 on an upstroke, with reference to FIG. 1, will effect movement of the plunger 30 upward from the position shown on a pump stroke against the bias force of the plunger return spring 70.

As previously described, the index ratchet gear 43 is provided with gear teeth 42 in mating engagement with the spiral gear teeth 41 on the plunger 30. Thus since the bearing balls 46 do not permit vertical motion of the index ratchet gear 43 during upward travel of the plunger 30, this index ratchet gear 43 must then rotate in a clockwise direction as seen in FIG. 2. It should be noted that the detent 61 engaged with a ratchet tooth 60 on the plunger 30 will prevent the rotation of the plunger in a counterclockwise direction, with reference to FIG. 3, this being the direction of rotation in which the plunger would otherwise tend to rotate because of its toothed engagement with the index ratchet gear 43. Accordingly, only the index ratchet gear 43 is free to rotate during this upward travel of the plunger, its associated detent 52 being forced to the right, with reference to FIGS. 1 and 2, overcoming the bias of the spring 55, as the inboard end of the detent 52 begins to slip over the beveled edge of the engaged ratchet tooth 53 on the index ratchet gear 43.

During its upward movement, the plunger 30 then covers (seals) the fuel inlet passage 40 and all but one discharge port passage 35 which is exposed via the discharge slot 34 of the plunger 30, the slot being in flow communication via the passage 32 and 33 with the pump chamber 31.

During continued upward movement of the plunger 30 and until injection is desired, the fuel will be discharged from the pump chamber 31 via the spill passage means, previously described, as permitted by the normally opened valve 85 of the solenoid valve assembly. Obviously, this spill of fuel from the pump chamber 31 prevents the intensified pressurization of the fuel within this chamber.

When injection is desired, the solenoid coil 92 is energized. Upon energization of the solenoid coil 92 the armature 94 will then move toward the pole piece 90 thus forcing the valve 85 into seating engagement with the valve seat 87 to thereby terminate fuel spill from the pump chamber 31. Thereafter, the fuel pressure in the pump chamber 31 during continued upward movement of the plunger 30, increases with the fuel then being discharged via the passages 32, 33 and discharge slot 34 to the then aligned discharged port passage 35 for delivery of fuel to the associate fuel injection nozzle, not shown, resulting in the discharge of fuel to the associate cylinder, not shown.

Injection timing and duration is thus controlled by means of the solenoid actuated valve 85. Thus when the solenoid coil 92 is again deenergized, the spill passages means is again opened and the fuel pressure in the pump chamber 31 and associated passages 32, 33 and 35 will quickly drop to supply tank pressure thus terminating injection.

During the entire upstroke of the plunger 30, the index ratchet gear 43 will have been rotating in a clockwise direction, with reference to FIG. 2. When the plunger 30 reaches its maximum upward travel (controlled by cam profile), the next ratchet tooth 53 on the index ratchet gear 43 will have been rotated at least 90° into a position such that the detent 52 can again snap into position behind the ratchet tooth 53 just moved into the position adjacent to the detent 52. The index ratchet gear 43 is thus once again locked against rotation in a counterclockwise direction, with reference to FIG. 2.

Figure 3:
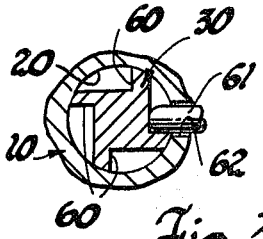

Now, as the plunger 30 then begins to descend on a suction stroke, as biased downward by the return spring 70, the plunger 30 must now rotate in a clockwise direction with reference to FIG. 3, since the index ratchet gear 43 is held from rotating in the opposite direction by its associated detent 52. As will be apparent the detent 61 in cooperation with the ratchet teeth 60 on the plunger 30 permits rotation of the plunger 30 in a clockwise direction but prevents its rotation in a counterclockwise direction. It should also be noted that the bearing balls 72 associated with the plunger 30 and the spring retainer 71, as previously described, allows rotation of the plunger relative to the spring 70.

When the associated cam lobe on cam 4 reaches its minimum profile, the plunger 30 will have been rotated at least 90°, with reference to the construction shown, so that the discharge slot 34 thereon will then be aligned with the next adjacent discharge port passage 35 so that fuel will be delivered to this next adjacent discharge port passage 35 on the next pump stroke of the plunger 30.

It should now be apparent to those skilled in the art that the spiral angle and the direction of inclination of the gear teeth 41 and 42 on the plunger 30 and index ratchet gear 43, respectively, is preselected so as to provide for the necessary degrees of rotation of first the index ratchet gear 43 and then of the plunger 30, in the desired direction, as a function of the number of cylinders of the engine with which the pump is to be associated. Thus in the embodiment shown, since the pump is intended for use on a four cylinder engine, the helix angle of these gear teeth is selected to effect at least 90° rotation of the respective elements in the manner described hereinabove and it is inclined in a direction to effect clockwise rotation of both the index ratchet gear 43 and of plunger 30, in the construction shown with reference to FIGS. 2 and 3.

The embodiments of the invention in which an exclusive property or privilege is claimed are defined as follows:

1. A fuel injection pump for the sequential delivery of fuel to the cylinders of an internal combustion engine, said pump including a housing means defining a pump cylinder with a plurality of circumferentially spaced apart discharge passages extending therefrom, the number of said discharge passages corresponding in number to the number of engine cylinders, and a fuel inlet passage to said pump cylinder axially spaced apart from said discharge passages; a pump plunger reciprocally received in the pump cylinder to define therewith a pump chamber with the inlet passaage being uncovered by the plunger during the suction stroke thereof and being covered by the plunger during the pumping stroke thereof; a discharge means including a discharge slot on said plunger for effecting flow communication between the pump chamber and one of said discharge passages; drive means including a driven means operatively associated with the opposite end of the plunger to effect reciprocation thereof in timed relationship to engine operation; a pawl and ratchet means including an indexing means operatively associated with said plunger whereby during a pump stroke of said plunger, said pawl and ratchet means is operative to prevent rotation of said plunger and whereby, during a suction stroke of said plunger, said plunger will be rotatably indexed so that said discharge slot of said plunger is moved into registration with the next in line said discharge passage; and, a solenoid valve controlled spill passage means in flow communication with said pump chamber for the controlled spill flow of fuel from said pump chamber during a pump stroke of said plunger whereby to control the start and end of fuel injection.

2. A fuel injection pump for an internal combustion engine including a housing means defining a pump cylinder with a plurality of circumferentially spaced apart discharge passage, corresponding in number to the number of cylinders of the associate engine, and a fuel inlet passage axially spaced from said discharge passages in flow communication with said pump cylinder; a plunger reciprocally received in the pump cylinder to define therewith a pump chamber with the inlet passage being uncovered by the plunger during the suction stroke thereof and being covered by the plunger during the pumping stroke thereof; a discharge slot means in said plunger for effecting flow communication from the pump chamber to one of said discharge passages; drive means including a driven means operatively associated with the opposite end of the plunger to effect reciprocation thereof in time relationship to engine operation; a first pawl and ratchet means operatively associated with said piston to limit indexed rotation thereof in one direction; an index ratchet gear operatively located in said housing means so as to operatively encircle said plunger; a pawl means operatively associated with said index ratchet gear; said plunger and said index ratchet gear each having cooperation helical gear teeth, whereby during a pump stroke, as said first pawl and ratchet means prevents rotation of said plunger, said gear teeth of said plunger will effect an indexed rotation of said index ratchet gear and whereby, during a suction stroke, said gear teeth of said ratchet gear means will effect angular rotation of said plunger so that said discharge slot means of said plunger will be sequentially advanced into registration with the next in line discharge passage; and, a solenoid valve controlled spill passage means in flow communication with said pump chamber for the controlled spill flow of fuel from said pump chamber during a pump stroke of said plunger whereby to control the start and end of fuel injection.

3. In a fuel injection pump for an internal combustion engine, said pump being adapted to be operatively connected to an engine and to an engine driven cam, said pump including a pump housing having a pump body with a stepped bore therethrough positioned for alignment with the engine driven cam, said pump body having a plurality of outlet ports and at least one inlet port communicating with said bore, a pump and distributing plunger member having one end thereof mounted for reciprocation and rotation in said bore and having a discharge slot means for flow communication with one of said outlet ports, a tappet means engaging at one end the opposite end of said plunger and adapted at its other end to operatively engage the cam for effecting a pump stroke of said plunger, a spring operatively connected to said plunger for effecting a suction stroke of said plunger, a pawl and ratchet means operatively associated with said plunger member to allow rotation thereof in only one direction; a ratchet gear and pawl means including an index ratchet gear operatively located in said housing means in position to operatively encircle said plunger member; said plunger member and said index ratchet gear each having cooperating helical gear teeth, whereby during a pump stroke, said gear teeth of said plunger member will effect an indexed rotation of said index ratchet gear and whereby, during a suction stroke, said gear teeth of said ratchet gear means will effect angular rotation of said plunger member so that said discharge slot means of said plunger member will be sequentially advanced into registration with the next in line outlet port; and, a solenoid valve controlled spill passage means in flow communication with said pump chamber for the controlled spill flow of fuel during a pump stroke of said plunger member whereby to control the start and end of fuel injection.

4. A fuel injection pump for supplying fuel sequentially to the cylinders of an internal combustion engine, said pump including a housing means defining a pump cylinder with a plurality of circumferentially spaced apart discharge passages, corresponding in number to the number of engine cylinders, and a fuel inlet passage axially spaced from said discharge passages extending from said pump cylinder; a plunger adapted to rotate and reciprocate in the pump cylinder to define therewith a pump chamber with the inlet passage being uncovered by the piston during the suction stroke thereof and being covered by the piston during the pumping stroke thereof; a fuel distributing slot means in said plunger for effecting flow communication from the pump chamber to one of said discharge passages; drive means including a driven means operatively associated with the opposite end of the piston to effect reciprocation thereof in timed relationship to engine operation; pawl and ratchet means operatively associated with said plunger; said pawl and ratchet means including an index ratchet gear operatively located in said housing means so as to operatively encircle said plunger; said plunger and said index ratchet gear having cooperating helical grooves and splines respectively, whereby during a pump stroke said plunger will effect an indexed rotation of said index ratchet gear and whereby, during a suction stroke said index ratchet gear will effect angular rotation of said plunger to effect registration of said slot means with the next in line discharge passage; and, a solenoid valve controlled spill passage means in flow communication with said pump chamber for the controlled spill flow of fuel from said pump chamber during a pump stroke of said piston whereby to control the start and end of fuel injection.

* * * * *